US009084037B2

(12) United States Patent
Derkx

(10) Patent No.: US 9,084,037 B2
(45) Date of Patent: Jul. 14, 2015

(54) AUDIO BEAMFORMING

(75) Inventor: Rene Martinus Maria Derkx, Eindhoven (NL)

(73) Assignee: KONINKLIJKE PHILIPS N.V., Eindhoven (NL)

( * ) Notice: Subject to any disclaimer, the term of this patent is extended or adjusted under 35 U.S.C. 154(b) by 781 days.

(21) Appl. No.: 13/384,720

(22) PCT Filed: Jul. 22, 2010

(86) PCT No.: PCT/IB2010/053335
§ 371 (c)(1),
(2), (4) Date: Jan. 18, 2012

(87) PCT Pub. No.: WO2011/010292
PCT Pub. Date: Jan. 27, 2011

(65) Prior Publication Data

US 2012/0114128 A1 May 10, 2012

(30) Foreign Application Priority Data

Jul. 24, 2009 (EP) ..... 09166297

(51) Int. Cl.
*H04R 29/00* (2006.01)
*H04R 3/00* (2006.01)

(52) U.S. Cl.
CPC ..... *H04R 3/005* (2013.01); *H04R 2201/401* (2013.01); *H04R 2430/25* (2013.01)

(58) Field of Classification Search
CPC ..... H04R 2201/401; H04R 2430/25; H04R 3/005
USPC ..... 381/56, 92, 94.1, 111, 122, 123; 367/129, 135; 700/94
See application file for complete search history.

(56) References Cited

U.S. PATENT DOCUMENTS

2005/0141731 A1* 6/2005 Hamalainen ..... 381/94.3
2006/0140417 A1 6/2006 Zurek
2009/0103749 A1* 4/2009 Goodwin ..... 381/92

FOREIGN PATENT DOCUMENTS

EP 1455552 A2 9/2004
WO 2009034524 A1 3/2009

OTHER PUBLICATIONS

Shimizu et al: "Isotropic Noise Suppression in the Power Spectrum Domain by Symmetric Microphone Arrays"; 2007 IEEE Workshop on Applications of Signal Processing to Audio and Acoustics, Oct. 21-24, 2007, New Paltz, NY, pp. 54-57.

(Continued)

*Primary Examiner* — Vivian Chin
*Assistant Examiner* — Friedrich W Fahnert

(57) ABSTRACT

An audio beamforming apparatus includes a receiving circuit (103) which receives signals from an at least two-dimensional microphone array (101). A reference circuit (105) generates reference beams and a combining circuit (107) generates an output signal corresponding to a desired beam pattern by combining the reference beams. An estimation circuit (109) generates a direction estimate by determining angles corresponding to local minima for a power measure of the output signal in at least a first and respectively second angle interval. The direction estimate is generated by selecting one of the angles. The combining circuit (107) determines combination parameters to provide a notch in an angle corresponding to the direction estimate and a maximization of a directivity cost measure where the directivity cost measure is indicative of a ratio between a gain in the first direction and an energy averaged gain.

15 Claims, 8 Drawing Sheets

(56) References Cited

OTHER PUBLICATIONS

McKinney et al: "Directionalizing Adaptive Multi-Microphone Arrays for Hearing Aids Using Cardioid Microphones"; IEEE International Conference on Acoustics, Speech, and Signal Processing, 1993, I-177-I-180.

Zhang et al: "Maximum Likelihood Sound Source Localization and Beamforming for Directional Microphone Arrays in Distributed Meetings"; IEEE Transactions on Multimedia, vol. 10, No. 3, Apr. 2008, pp. 538-548.

Saruwatari et al: "Speech Enhancement Using Nonlinear Microphone Array With Noise Adaptive Complementary Beamforming"; IEEE, 2000, pp. 1049-1052.

R. Derkx: "Adaptive Azimuthal Null-Steering for a First-Order Microphone Response"; Proceedings of the 12th International Workshop on Acoustic Echo and Noise Control, Aug. 30-Sep. 2, 2010, Tel-Aviv, Israel, 4 Page Document.

R. Derkx: "Optimal Azimuthal Steering of a First-Order Superdirectional Microphone Response"; Proceedings of the 11th International Workshop on Acoustic Echo and Noise Control, Sep. 14-17, 2008, Seattle, WA, 4 Page Document.

Nagata et al: "Two-Channel Adaptive Microphone Array With Target Tracking"; Electronics and Communications in Japan, Part 3, vol. 83, No. 12, 2000, pp. 19-24.

* cited by examiner

AUDIO BEAMFORMING

FIELD OF THE INVENTION

The invention relates to audio beamforming and in particular, but not exclusively, to audio beamforming using microphone arrays substantially smaller than the wavelength of the audio signals being beamformed.

BACKGROUND OF THE INVENTION

Advanced processing of audio signals has become increasingly important in many areas including e.g. telecommunication, content distribution etc. For example, in some applications, such as hands-free communication and voice control systems, complex processing of inputs from a plurality of microphones has been used to provide a configurable directional sensitivity for a microphone array comprising the microphones. Specifically, the processing of signals from a microphone array can generate an audio beam with a direction that can be changed simply by changing the characteristics of the combination of the individual microphone signals.

Typically, beam form algorithms seek to attenuate interferers while providing a high gain for a desired sound source. For example, a beamforming algorithm can be controlled to provide a strong attenuation (preferably a null) in the direction of a signal received from a main interferer.

For practical reasons it is desirable that the microphone array is relatively small. However, when the wavelength of the sound of interest is much larger than the size of the array, many beamforming algorithms, such as additive delay-and-sum beamforming algorithms, are not able to provide sufficient directivity as the beamwidth deteriorates substantially for such wavelengths.

One approach for achieving an improved directivity is to apply so called superdirective beamforming techniques. Such superdirective beamforming techniques are based on filters with asymmetrical filter coefficients and the approach essentially corresponds to subtraction of signals or determining spatial derivatives of the sound pressure field. However, although this may improve the directivity, it is also known that this is achieved at the expense of robustness, such as increased sensitivity to white (sensor) noise and an increased sensitivity to mismatches in microphones characteristics.

In the article "Optimal Azimuthal Steering of a First-order Superdirectional Microphone Response" by R. M. M. Derkx, International Workshop on Acoustic Echo and Noise Control, September 2008, Seattle, a system is analyzed which generates Eigenbeams for a two dimensional microphone array. The Eigenbeams are then combined to maximize the attenuation of a single point interference source. In particular, a null is located in the direction of a single point interferer while maintaining a suitable gain for the desired direction.

However, although this approach provides improved performance in many scenarios, it provides non optimal performance in some practical scenarios. It also tends to require relatively complex and resource demanding processing.

Hence, an improved approach for audio beamforming would be advantageous and in particular an approach allowing improved adaptation to current conditions and audio environment, increased flexibility, facilitated implementation, improved performance for different operating scenarios and/or improved performance would be advantageous.

SUMMARY OF THE INVENTION

Accordingly, the Invention seeks to preferably mitigate, alleviate or eliminate one or more of the above mentioned disadvantages singly or in any combination.

According to an aspect of the invention there is provided an audio beamforming apparatus comprising: a receiving circuit for receiving signals from an at least two-dimensional microphone array comprising at least three microphones; a reference circuit for generating at least three reference beams from the microphone signals; combining circuit for generating an output signal corresponding to a desired beam pattern by combining the reference beams in response to a first direction of a desired sound source and a direction estimate for an interfering sound source; an estimation circuit for generating the direction estimate by: determining a first angle corresponding to a local minimum for a power measure of the output signal in a first angle interval, determining a second angle corresponding to a local minimum for a power measure of the output signal in a second angle interval, and determining the direction estimate as an angle selected from a set of angles corresponding to local minima for a power measure of the output signal, the set of angles comprising at least the first angle and the second angle; and wherein the combining circuit is arranged to determine combination parameters for the combining of the reference beams to provide a notch in an angle corresponding to the direction estimate and a minimization of a directivity cost measure, the directivity cost measure being indicative of a ratio between a gain in the first direction and an average gain.

The invention may allow improved performance. In particular, an improved and/or facilitated adaptation to a current audio environment can be achieved. The invention may allow a beamforming approach which provides high performance for both directional point interference cancellation and for diffuse noise attenuation. The approach is particularly suitable for, and may provide particularly advantageous performance for, systems wherein the wavelength of the audio signals may be substantially larger than the size of the microphone array.

The invention may allow low complexity implementation and/or operation. The approach may be suitable for providing improved directivity and may in particular be suitable for scenarios wherein the size of the microphone array is much smaller than a wavelength of interest.

In many embodiments and scenarios, the approach may allow a null to be directed towards a single point interference while substantially reducing diffuse noise. In particular, the approach may in many scenarios allow a reduction of a single point interference corresponding to or better than many prior art interference reduction techniques, while at the same time providing improved diffuse noise.

The approach may in many scenarios allow a low complexity yet highly efficient and advantageous beam steering based on low complexity parallel local minima extraction. In many embodiments, the approach may ensure that at least one of the identified local minima is also a global minimum and thus may allow an efficient estimation of the angle of interference.

The reference beams may be non-adaptive and may be independent of the captured signals and/or the audio conditions. The reference beams may be constant and may be generated by a constant/non-adaptive combination of the signals from the at least three microphones. The reference beams may specifically be Eigenbeams or orthogonal beams.

The first angle interval and the second angle interval may be disjoint intervals and may be adjacent intervals. The first and second angle intervals may together cover the entire 360° interval.

The interfering sound source may be an assumed interfering sound source. A direction estimate for a sound source may be generated independently of whether the sound source is present or not. Thus, even if no interfering point source is detected, the estimation circuit may generate the direction estimate from the microphone signals under the assumption that an interfering sound source is present.

In accordance with an optional feature of the invention, the estimation circuit is arranged to select the direction estimate as one of the first angle and the second angle in response to a gradient of a power measure of the output signal as a function of the direction estimate for an angle separating the first angle interval and the second angle interval.

This may provide a particularly efficient and low complexity determination of the direction estimate. The angle may be any angle between the first angle interval and the second angle interval including the end points of one or both of the angle intervals.

In accordance with an optional feature of the invention, the first angle interval comprises angles from 0 to $\pi$ and the second angle interval comprises angles from $\pi$ to $2\pi$.

This may provide particularly advantageous performance and may in particular allow adaptation for all possible directions of the interfering sound source.

In accordance with an optional feature of the invention, the estimation circuit is arranged to select the direction estimate as one of the first angle and the second angle in response to a gradient of a power measure of the output signal as a function of the direction estimate for an angle of $\pi$.

This may provide a particularly efficient and low complexity determination of the direction estimate.

In accordance with an optional feature of the invention, the combining circuit comprises a sidelobe canceller.

This may provide particularly advantageous performance and/or practical implementation.

In accordance with an optional feature of the invention, the sidelobe canceller is arranged to generate the output signal as a weighted combination of at least a primary signal, a first noise reference signal and a second noise reference signal.

This may provide particularly advantageous performance and/or practical implementation. The primary signal may correspond to a beam adapted in the direction of the desired sound source and each of the reference signals may correspond to beams adapted to cancel/reduce noise. The noise reference signals may specifically have notches in the direction of the desired sound source.

In accordance with an optional feature of the invention, the combining circuit is arranged to calculate weights for the first and second noise reference signals in response to the direction estimate and maximization of the directivity cost measure.

This may provide a particularly advantageous performance and/or low complexity implementation. In particular, the weights may be determined as a function of the direction estimate wherein the function is selected to maximize the directivity cost measure.

In accordance with an optional feature of the invention, the estimation circuit is arranged to determine at least one of the first and second angles by a gradient search applied to a sidelobe canceller corresponding to the sidelobe canceller of the combining circuit and having an angle input variable.

This may provide a particularly advantageous performance and/or low complexity implementation. In particular, a gradient search may provide a highly efficient approach for identifying potential minima that may optimize the beamforming operation. An efficient and low complexity adaptation of the beamforming may be achieved which can reduce both diffuse noise and reduce/cancel a single point interference.

In many embodiments both the first and single angle are determined by a gradient search. The gradient search may be performed using a sidelobe canceller operation which is identical to the sidelobe canceller operation used to generate the output signal but with a value of the angle input variable that may be different than the phase value (the direction estimate) used to generate the output signal (thus which can be varied independently).

In some embodiments, a gradient search may be applied in parallel in the two angle intervals using parallel sidelobe canceller operations with independent angle input variables. The output signal of the combining circuit may be selected as the signal of the parallel sidelobe canceller corresponding to the selected angle of the first and second angles.

In some embodiments, a sidelobe canceller corresponding to the sidelobe canceller of the combining circuit may be used to determine a gradient of a power measure of the output signal for a given angle (specifically $\pi$) and the selection between the first and second angle may be in response to the gradient.

In accordance with an optional feature of the invention, an update value for the angle input variable is determined as a function of an output signal of the sidelobe canceller for a current phase value of the angle input variable, and a first and second noise reference signal of the sidelobe canceller for the current phase value.

This may provide particularly advantageous performance and/or facilitated implementation and/or operation.

In accordance with an optional feature of the invention, the first and second noise reference signals are weighted as a function of the current phase value.

This may provide particularly advantageous performance and/or facilitated implementation or operation.

In accordance with an optional feature of the invention, the estimation circuit is arranged to determine a power estimate for at least one of the first and second noise reference signals and to perform a normalization of the update value as a function of the power estimate.

This may provide particularly advantageous performance and/or facilitated implementation and/or operation.

In accordance with an optional feature of the invention, the at least two-dimensional microphone array comprises at least four microphones and the apparatus comprises a circuit for combining signals from at least two of the at least four microphones prior to generating the reference beams.

This may provide particularly advantageous performance and/or facilitated implementation and/or operation. In particular, it may provide improved noise performance in many scenarios.

In accordance with an optional feature of the invention, the apparatus of further comprises the at least two-dimensional microphone array, the at least two-dimensional microphone array comprising directional microphones having a maximum response in a direction outwardly of a perimeter of the at least two-dimensional microphone array.

This may provide particularly advantageous performance and/or facilitated implementation and/or operation.

According to an aspect of the invention there is provided a method of audio beamforming comprising: receiving signals from an at least two-dimensional microphone array comprising at least three microphones; generating at least three reference beams from the microphone signals; generating an output signal corresponding to a desired beam pattern by combining the reference beams in response to a first direction of a desired sound source and a direction estimate for an interfering sound source; generating the direction estimate by: determining a first angle corresponding to a local minimum for a power measure of the output signal in a first angle interval, determining a second angle corresponding to a local minimum for a power measure of the output signal in a second angle interval, and determining the direction estimate as an angle selected from a set of angles corresponding to local minima for a power measure of the output signal, the set of angles comprising at least the first angle and the second angle; and wherein the combining of the reference beams comprises determining combination parameters for the combining of the reference beams to provide a notch in an angle corresponding to the direction estimate and a minimization of a directivity cost measure, the directivity cost measure being indicative of a ratio between a gain in the first direction and an energy averaged gain.

These and other aspects, features and advantages of the invention will be apparent from and elucidated with reference to the embodiment(s) described hereinafter.

BRIEF DESCRIPTION OF THE DRAWINGS

Embodiments of the invention will be described, by way of example only, with reference to the drawings, in which.

DETAILED DESCRIPTION OF SOME EMBODIMENTS OF THE INVENTION

Figure 1:
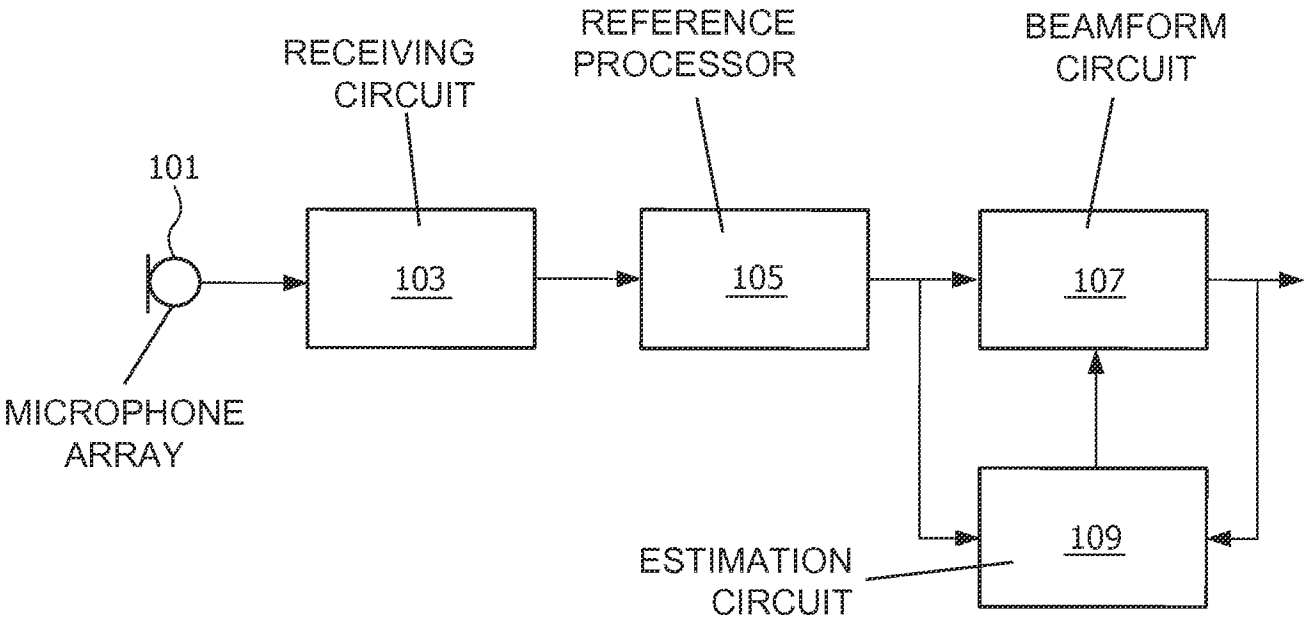
FIG. 1 illustrates an example of a system for capturing audio with an adaptable directional characteristic in accordance with some embodiments of the invention.

FIG. 1 illustrates an example of a system for capturing audio with an adaptable directional characteristic. The system processes signals from a plurality of microphones to generate a suitable desired beam pattern. The processing is specifically adapted such that the generated output signal has substantially improved noise and interference characteristics. The system provides for a joint improvement in both single point interference and diffuse noise performance. The system is furthermore suitable for use in scenarios wherein the wavelength of the signals is substantially longer than the dimensions of the microphone array, i.e. than the distances between the microphones.

The system processes the received microphone signals to generate a set of constant non-adaptable reference beams. These reference beams are then adaptively combined to generate a desired beam pattern. The combination is adapted such that the resulting beam form is adapted to cancel or substantially attenuate an assumed single point interference source while at the same time minimizing or reducing the impact of diffuse noise.

The system provides an efficient adaptive beamforming where the main lobe can be steered towards the direction of a desired sound source while adapting the directional pattern such that a point interferer from another angle is effectively rejected and a substantially optimal rejection of diffuse (isotropic) noise is achieved. The system of FIG. 1 specifically includes an adaptive null-steering scheme with multiple gradient-estimates for adjusting the directivity pattern in such a way that this effective rejection of noise and interference can be achieved automatically.

The system of FIG. 1 comprises a microphone array 101 which is a two-dimensional microphone array. The microphone array 101 comprises at least three microphones which are not arranged in a single one dimensional line. In most embodiments, the shortest distance from one microphone to a line going through two other microphones is at least a fifth of the distance between these two microphones.

Figure 2:
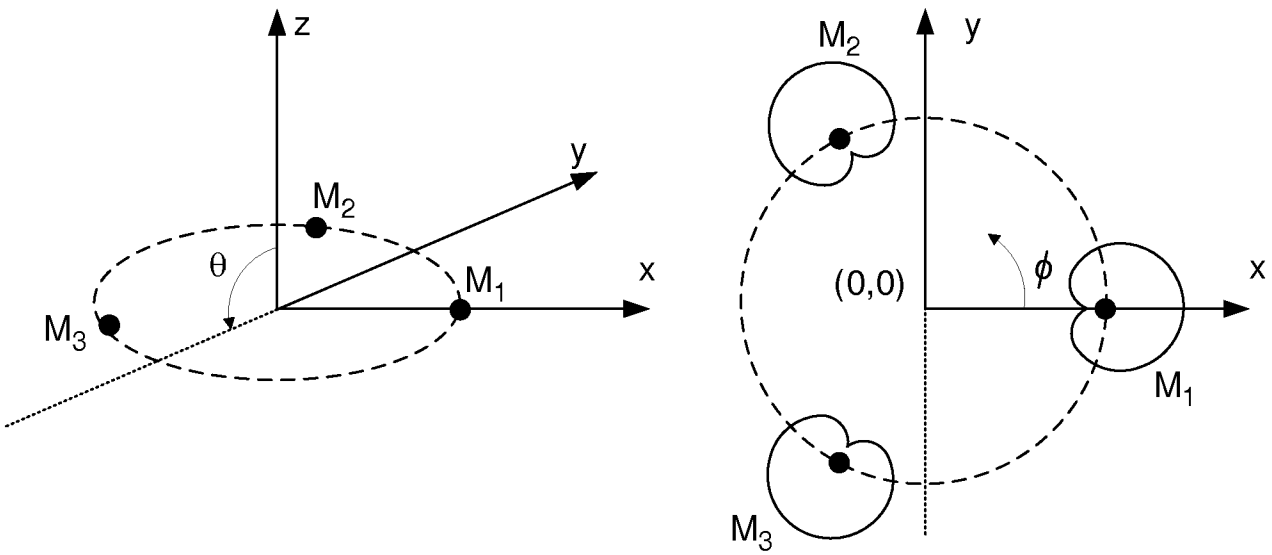
FIG. 2 illustrates an example of a microphone configuration for a microphone array.

In the specific example, the microphone array 101 comprises three microphones which are spaced uniformly on a circle as illustrated in FIG. 2.

Thus, in the example a circular array of at least three (omni- or uni-directional) sensors in a planar geometry is used. It will be appreciated that in other embodiments, other arrangements of the microphones may be used. It will also be appreciated that for embodiments wherein more than three microphones are used, these may possibly be arranged in a non-planar geometry, i.e. the microphone array may be a three dimensional microphone array. However, the following description will focus on a three microphone equidistant circular array arranged in the azimuth plane.

The microphone array 101 is coupled to a receiving circuit 103 which receives the microphone signals. In the example of FIG. 1, the receiving circuit 103 is arranged to amplify, filter and digitize the microphone signals as is well known to the skilled person.

The receiving circuit 103 is coupled to a reference processor 105 which is arranged to generate at least three reference beams from the microphone signals. The reference beams are constant beams that are not adapted but are generated by a fixed combination of the digitized microphone signals from the receiving circuit 103. In the example of FIG. 1, three orthogonal Eigenbeams are generated by the reference processor 105.

In the example, the three microphones of the microphone array are directional microphones and are specifically uni-directional cardioid microphones which are arranged such that the main gain is pointing outwardly from the perimeter formed by joining the positions of the microphones (and thus outwardly of the circle of the circular array in the specific example). The use of uni-directional cardioid microphones provides an advantage in that the sensitivity to sensor noise and sensor-mismatches is greatly reduced. However, it will be appreciated that in other scenarios other microphone types may be used, such as omni-directional microphones.

Denoting the responses of the three cardioid microphones as respectively $E_C^0$, $E_C^{2\pi/3}$ and $E_C^{4\pi/3}$ and ignoring any uncorrelated sensor-noise, the i'th cardioid microphone response is ideally given by:

$$E_C^{2i\pi/3} = \left[\frac{1}{2} + \frac{1}{2}\cos\left(\phi - \frac{2i\pi}{3}\right)\sin\theta\right]e^{j\psi_i}, \text{ with}$$

$$\psi_i = \frac{2\pi f}{c}\sin\theta(x_i\cos\phi + y_i\sin\phi),$$

where θ and Φ are the standard spherical coordinate angles: elevation and azimuth, c is the speed of sound and $x_i$ and $y_i$ are the x and y coordinates of the i'th microphone.

Using:

$$x_i = r\cos\left(\phi - \frac{2i\pi}{3}\right), \text{ and } y_i = r\sin\left(\phi - \frac{2i\pi}{3}\right),$$

with r the radius of the circle we can write:

$$\psi = \frac{2\pi f}{c}\sin\theta\cos\left(\frac{2i\pi}{3}\right)r.$$

From the three cardioid microphones, the three orthogonal Eigenbeams can be determined from:

$$\begin{bmatrix} E_m \\ E_d^0 \\ E_d^{\pi/2} \end{bmatrix} = \frac{2}{3}\begin{bmatrix} 1 & 1 & 1 \\ 2 & -1 & -1 \\ 0 & \sqrt{3} & -\sqrt{3} \end{bmatrix}\begin{bmatrix} E_c^0 \\ E_c^{2\pi/3} \\ E_d^{4\pi/3} \end{bmatrix}.$$

For wavelengths larger than the size of the array, the responses of the Eigenbeams are frequency invariant and ideally equal to:

$$E_m=1.$$

$$E_d^0(\theta,\phi)=\cos\phi\sin\theta$$

$$E_d^{\pi/2}(\theta,\phi)=\cos(\phi-\pi/2)\sin\theta.$$

Figure 3:
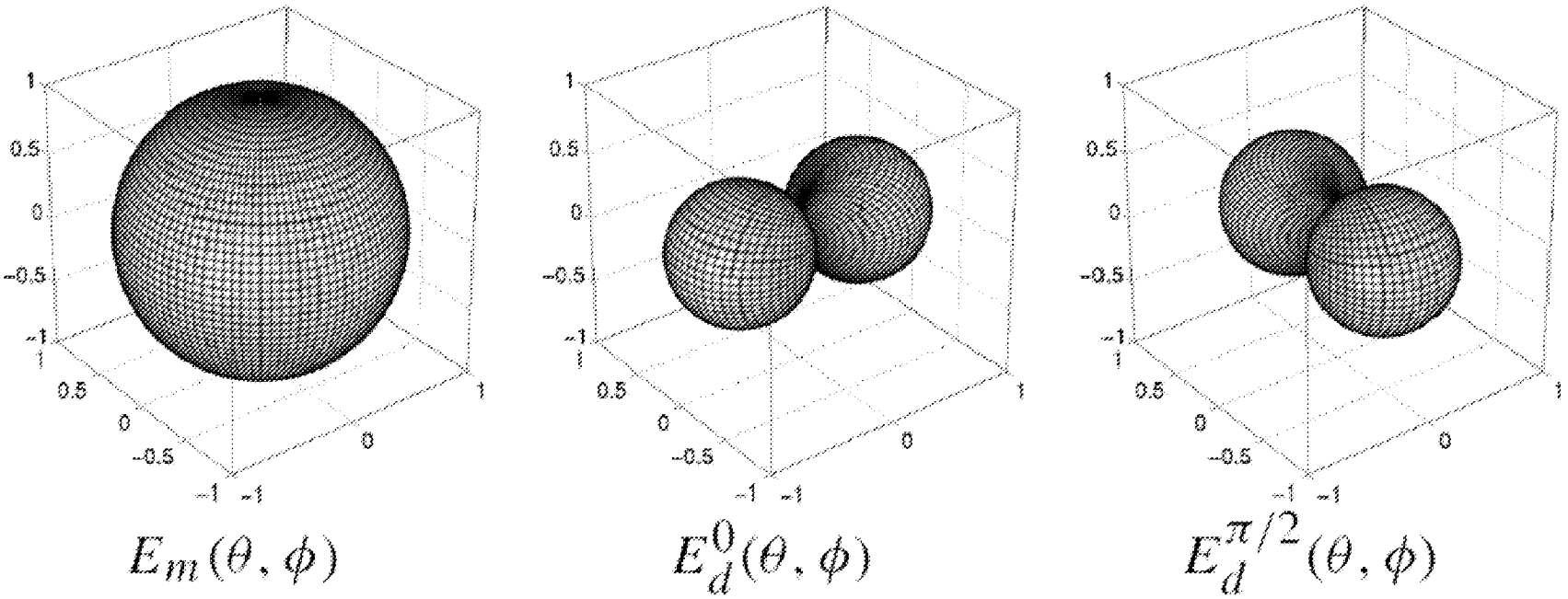
FIG. 3 illustrates an example of Eigenbeams generated by the system of FIG. 1.

The directivity patterns of these Eigenbeams are illustrated in FIG. 3.

The zero'th-order Eigenbeam Em represents the monopole response corresponding to a sphere whereas the other Eigenbeams represent first order Eigenbeams corresponding to double spheres as illustrated in FIG. 3. Thus, the two first order Eigenbeams are orthogonal dipoles.

The resulting signals from each of the three Eigenbeams are fed to a beamform circuit 107 which proceeds to adaptively combine these signals to provide a desired beam pattern.

Specifically, by suitable combining the first order Eigenbeams, a dipole can be steered to any angle $\phi_s$. E.g. a weighted summation of the orthogonal diagonals can be generated:

$$E_d^{\phi_s}(\theta,\phi)=\cos\phi_s E_d^0(\theta,\phi)+\sin\phi_s E_d^{\pi/2}(\theta,\phi),$$

where $\phi_s$ represents the desired angle for the resulting dipole.

The steered and scaled superdirectional microphone response can then be constructed by combining the steered dipole with the monopole, e.g. as:

$$\begin{aligned} E(\theta,\phi) &= S[\alpha E_m + (1-\alpha)E_d^{\varphi_s}(\theta,\phi)] \\ &= S[\alpha + (1-\alpha)\cos(\phi-\varphi_s)\sin\theta], \end{aligned}$$

where $\alpha \leq 1$ is a parameter for controlling the directional pattern of the first-order response and S is an arbitrary scaling factor (that can also have negative values).

Thus, the beamform circuit 107 can generate a suitable beam pattern by a suitable combination of the reference Eigenbeams. The beamform circuit 107 is arranged to generate a nominal (e.g. unity) gain in the direction of a desired speaker coming from an arbitrary azimuthal angle $\Phi=\phi_s$. The direction of the desired speaker is assumed to be known by the beamform circuit 107. It will be appreciated that any suitable way of determining a desired direction may be used without detracting from the invention. For example, a fixed direction may be used or e.g. a tracking algorithm for a desired speaker or sound source may be used. It will be appreciated that many different algorithms for determining a desired sound source direction will be known to the skilled person.

The beamform circuit 107 is furthermore arranged to adapt the beam such that the sensitivity to diffuse noise is minimized and a notch is generated in an estimated direction of an assumed interfering point source. The system of FIG. 1 is specifically arranged to adapt the combination of the reference Eigenbeams such that the nominal gain is provided in the desired direction, a notch is generated in the direction estimated to correspond to a point source interference and with a minimization of the diffuse noise under these constraints. This is achieved by a highly efficient adaptation algorithm which will be described in the following.

The beamform circuit 107 is specifically coupled to an estimation circuit 109 which determines an estimate for the direction to an assumed point source interference. Based on the estimated direction, the beamform circuit 107 generates combination parameters for the combination of the Eigenbeams such that a notch (typically a null) is generated in the estimated direction. However, the combination of three Eigenbeams provides sufficient degrees of freedom to allow a range of solutions to the constraint of providing a nominal gain in a desired direction and a notch in an interference direction. In the system, this additional degree of freedom is used to improve the diffuse noise performance. This is specifically achieved by the combination parameters being selected to maximize a directivity cost measure where the directivity cost measure is indicative of a ratio between a power/energy gain in the first direction and an average power/energy gain. Specifically, the directivity cost measure may be indicative of the gain in the desired direction relative to an average gain of the resulting beam where the averaging is over all angles in the azimuth plane (Le. from 0-2π) or from all directions in the three dimensions. Thus, the directivity cost measure is a function which indicates the attenuation of homogenous spatially diffuse noise (i.e. the same noise level in all direction) provided by the beam pattern.

The estimation circuit 109 is specifically arranged to determine the estimated angle of an interference point by searching for local minima of a power measure for the output signal. Thus, the estimation circuit 109 seeks to minimize the power of the output signal as this will correspond to the lowest noise/interference. In some embodiments, the estimation may only be performed when the desired sound source is inactive (e.g. when a desired speaker is not speaking) but it will be appreciated that this is not necessary for the minimization of the power of the output signal to be an indication of optimal noise/interference operation (specifically the presence of the desired signal may introduce an offset to the power measure but will not change the position of the minimum).

The estimation circuit 109 determines at least two local minima by searching in at least two angle intervals. The two angle intervals are typically disjoint, although in some embodiments some overlap may occur. The local minima are determined in the different angle intervals by a parallel processing based on different angles. Specifically, the estimation circuit 109 may copy the operation of the beamform circuit 107 and evaluate the resulting output signal for different angles in the different angle intervals. The estimation circuit 109 may then select one of the angles that have been found to correspond to a local minima for the output signals and the selected angle is then used as the estimate for the assumed single point interference source. The selected angle is then fed to the beamform circuit 107 which proceeds to perform the combination such that a nominal gain is provided in the direction of the desired source and a notch is provided in the estimated direction of the main single point interference. Furthermore, the combination uses weights that are selected to further minimize the diffuse noise. This constraint is imposed by the weights being selected to maximize directivity cost measure.

The estimation operation and adaptation is independent of the actual noise and interference conditions and specifically is independent of whether a significant single point interferer or diffuse noise is present or not. However, the approach results in very efficient performance across a wide variety of scenarios including scenarios with a dominant single point interference and no diffuse noise as well as scenarios with no single point interference but substantial diffuse noise. Indeed, the approach and underlying assumptions result in an operation that not only adapts to the specific characteristics of the noise and single point interference characteristics but also adapts to the type of noise/interference scenario that is experienced. This also reduces complexity and facilitates operation as there is no need to adapt the algorithm to the type of audio environment being experienced. This also provides increased flexibility and a wider application of the approach.

In the following, a specific example of the system of FIG. 1 will be described. In the example, the beamform circuit 107 implements a sidelobe canceller and the local minima are determined using a gradient search within each angle interval. Once the direction to the assumed single point interference has been estimated, combination parameters in terms of the weights applied to the noise reference signals are determined under the constraint that the directivity cost measure is maximized.

Figure 4:
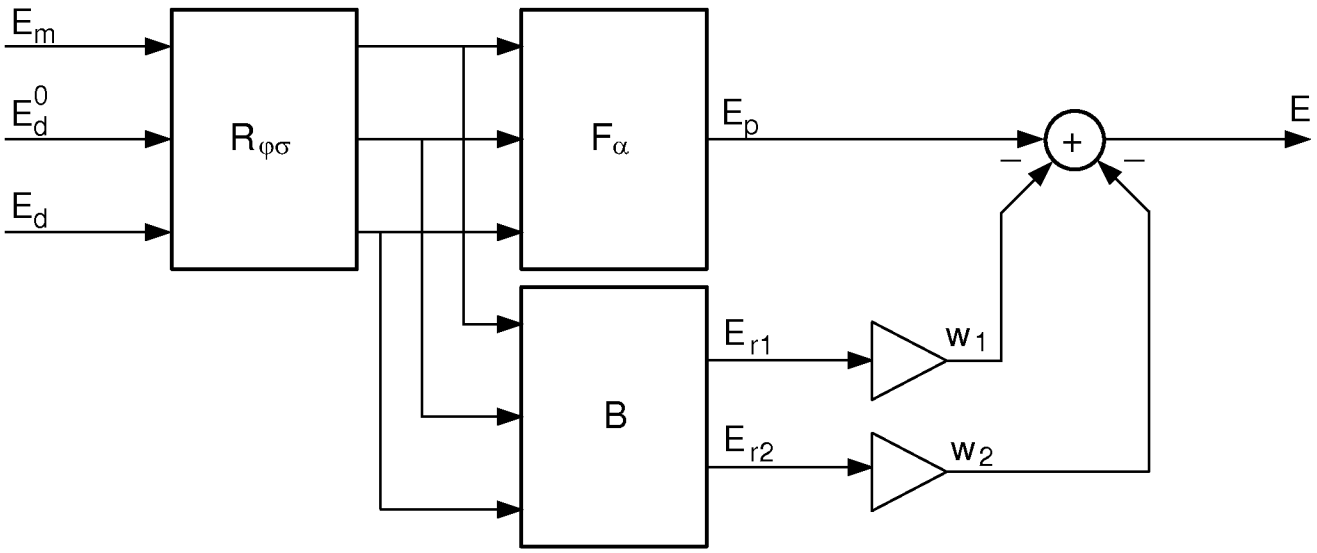
FIG. 4 illustrates an example of a sidelobe canceller used in the system of FIG. 1.

FIG. 4 illustrates an example of a generalized sidelobe canceller used in the system of FIG. 1. The two dipole reference beams are first combined to generate two dipoles which are angled in the desired directions. The resulting dipoles are then combined with the monopole to generate a primary signal which corresponds to a beam directed towards the desired audio source.

The primary response may be given by $$E_p(\theta,\phi)=F_\alpha^T R_{\phi_s} X.$$

where $$R_{\varphi_s}=\begin{bmatrix}1 & 0 & 0\\ 0 & \cos\varphi_s & \sin\varphi_s\\ 0 & -\sin\varphi_s & \cos\varphi_s\end{bmatrix}$$

$$F_\alpha=\begin{bmatrix}\alpha\\ (1-\alpha)\\ 0\end{bmatrix}\text{ and}$$

$$X=S\begin{bmatrix}E_m\\ E_d^0(\theta,\phi)\\ E_d^{\pi/2}(\theta,\phi)\end{bmatrix}=S\begin{bmatrix}1\\ \cos\phi\sin\theta\\ \sin\phi\sin\theta\end{bmatrix}.$$

The primary signal thus corresponds to the desired audio signal but also comprises signals from undesired directions. The impact of these sidelobes is reduced by generation of noise reference signals which are weighted and subtracted from the primary signal to generate the output signal.

Thus, the sidelobe canceller generates the noise reference signals given by $$\begin{bmatrix}E_{r_1}(\theta,\phi)\\ E_{r_2}(\theta,\phi)\end{bmatrix}=B^T R_{\varphi_s} X$$

where B is a blocking matrix given by:

$$B=\begin{bmatrix}\frac{1}{2} & 0\\ -\frac{1}{2} & 0\\ 0 & 1\end{bmatrix}.$$

It is noted that the noise-references are respectively a cardioid and a dipole response, with a null steered towards the primary signal at azimuth $\phi_s$ and elevation $\theta=\pi/2$.

The two noise reference signals are then weighted by weights $w_1$ and $w_2$ before being subtracted from the primary signal to provide the output signal. Thus, the overall beampattern from the sidelobe canceller is given by:

$$E(\theta,\phi)=E_p(\theta,\phi)-w_1E_{r_1}(\theta,\phi)-w_2E_{r_2}(\theta,\phi).$$

The beamform circuit 107 is arranged to generate a nominal gain, in the following a unity gain, in a desired angle $\phi_s$ and a notch, specifically a zero, in the direction $\phi_n$ of an assumed single point interference determined by the estimation circuit 109.

With a unity gain in the direction of $\phi_s$, the weights required to steer a zero towards the angle $\phi_n$ can be calculated by solving the equation:

$$E_p(\pi/2,\phi)-w_1E_{r_1}(\theta,\phi)-w_2E_{r_2}(\theta,\phi)=0.$$

where $\phi=\phi_s-\phi_n$.

Solving the equation yields:

$$w_1=\frac{2[\alpha+(1-\alpha)\cos\varphi-w_2\sin\varphi]}{1-\cos\varphi},$$

or alternatively:

$$\omega_2=\frac{\alpha+(1-\alpha)\cos\varphi-\frac{m_1}{2}(1-\cos\varphi)}{\sin\varphi}.$$

As can be seen, the constraints of the unity gain and the direction of the zero do not uniquely define the required weights but provide an extra degree of freedom.

In the system, this degree of freedom is used to optimize diffuse noise performance. In particular, the noise reference weights are selected such that a directivity cost measure is maximized.

A suitable directivity cost measure is given by:

$$Q_S=\frac{4\pi E^2(\pi/2,\varphi_s)}{\int_{\phi=0}^{2\pi}\int_{\theta=0}^{\pi}E^2(\theta,\phi)\sin\theta d\theta d\phi}$$

Thus, the directivity cost measure represents a ratio between the gain in the desired direction and the overall (power) gain averaged over the entire sphere. It will be appreciated that in other embodiments, the gain averaging may e.g. only be in a two-dimensional plane such as the azimuth plane.

For the response given by $$E(\theta, \phi) = S[\alpha E_m + (1-\alpha)E_d^{\varphi_s}(\theta, \phi)]$$
$$= S[\alpha + (1-\alpha)\cos(\phi - \varphi_s)\sin\theta],$$

this can be shown to correspond to:

$$Q_S = \frac{3}{(1 - 2\alpha + 4\alpha^2)}.$$

Inserting the output signal response given by:

$$E(\theta,\phi)=E_p(\theta,\phi)-w_1E_{r_1}(\theta,\phi)-w_2E_{r_2}(\theta,\phi),$$

and inserting the value of w1 as given by:

$$\omega_1 = \frac{2[\alpha + (1-\alpha)\cos\varphi - \omega_2\sin\varphi]}{1-\cos\varphi}.$$

in the directivity cost measure, and differentiating with respect to w2 and setting the result to zero allows for the minima of the directivity cost measure with respect to w2 to be determined. Thus, the value of w2 for which the directivity cost measure is maximized and thus the diffuse noise sensitivity is minimized can be determined. This specifically yields:

$$w_2 = \frac{-\sin\varphi(3\cos\varphi + 1)}{3\cos^2\varphi + 2\cos\varphi - 5}.$$

With this value of $w_2$, we can also compute $w_1$ as:

$$w_1 = \frac{2(3\alpha\cos\varphi + 5\alpha - 1)}{3\cos\varphi + 5}$$
$$= 2\alpha - \frac{2}{3\cos\varphi + 5}.$$

Thus, $w_1$ and $w_2$ can be calculated such that a unity gain is provided in the desired direction, a zero is formed in the direction of an assumed interferer and the diffuse noise attenuation is maximized under these constraints.

Thus, once the estimation circuit 109 has determined a suitable angle estimate for the assumed point source interferer, the derived equations can be used to calculate suitable weights that will also maximize the directivity cost measure and thus optimize the diffuse noise performance.

Rather than using the previously derived equation for $w_1$, a value compensated for the effect of the design parameter can be used:

$$\tilde{w}_1 = \omega_1 - 2\alpha$$
$$= \frac{-2}{3\cos\varphi + 5}.$$

It can be shown that $w_2$ can then be derived from:

$$w_2 = \frac{3}{2}\sin\varphi\frac{\tilde{w}_1(1 + 2\tilde{w}_1)}{4\tilde{w}_1 + 1}.$$

Thus, the output signal y[k] is given by:

$$y[k]=p[k]-(\hat{w}_1[k]+2\alpha)r_1[k]-\hat{w}_2[k]r_2[k],$$

with $$\hat{w}_1[k] = \frac{-2}{3\cos\hat{\varphi}[k] + 5},$$
$$\hat{w}_2[k] = \frac{3}{2}\sin\hat{\varphi}[k]\frac{\hat{w}_1[k](1 + 2\hat{w}_1[k])}{4\hat{w}_1[k] + 1},$$
$$\hat{\varphi}[k] = \hat{\varphi}_n[k] - \varphi_s,$$

where is the estimate of the angle of the assumed undesired interferer and $\phi_s$ is the angle of the desired audio source.

The estimation circuit 109 proceeds to determine the direction estimate by minimizing a power measure for the output signal in different angle intervals.

Specifically, the estimation circuit 109 seeks to maximize the cost function given by:

$$J(\hat{\phi})=\epsilon\{y^2[k]\},$$

where denotes the expected value.

Figure 5:
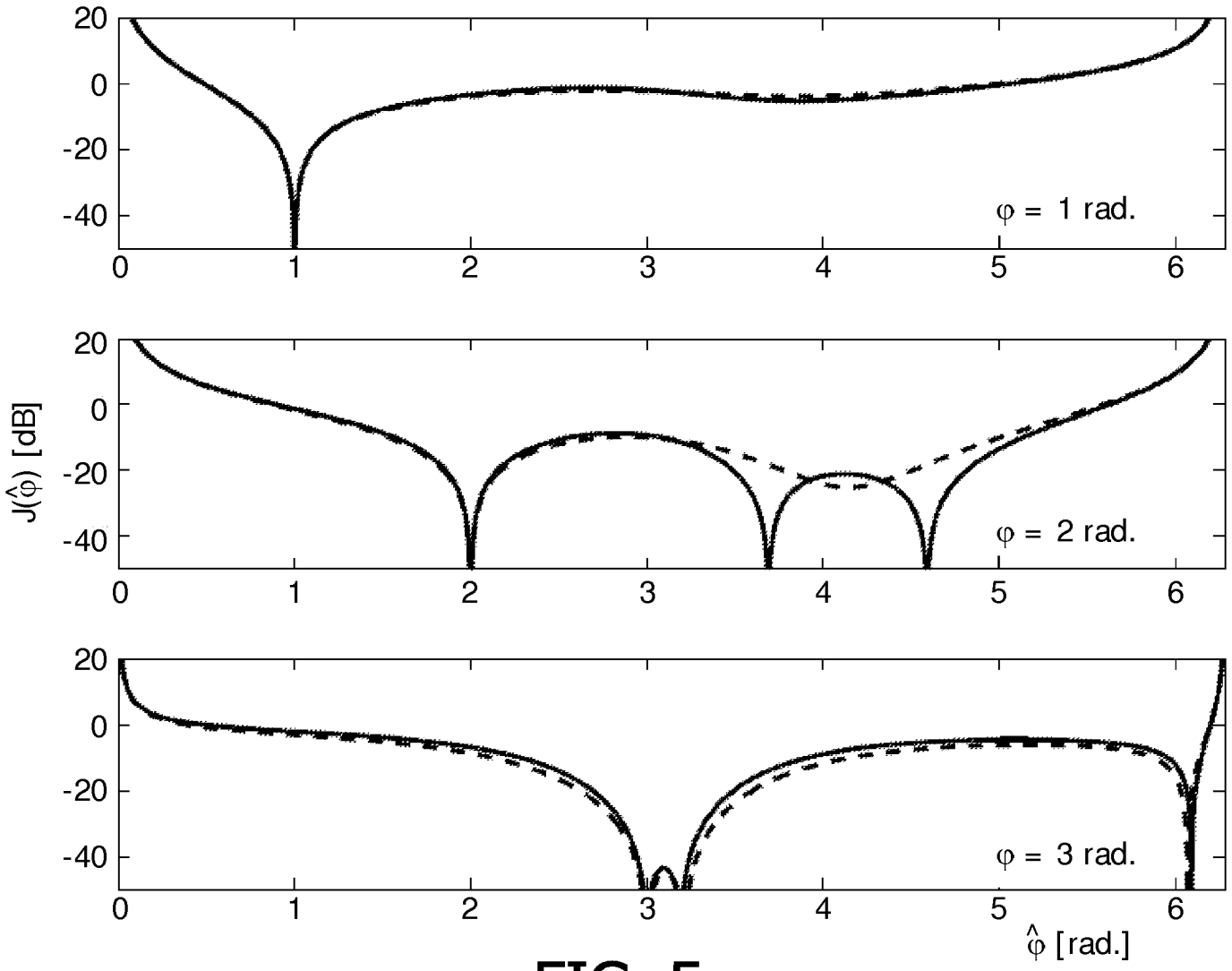
FIG. 5 illustrates an example of a cost function for adapting the system of FIG. 1.
Figure 6:
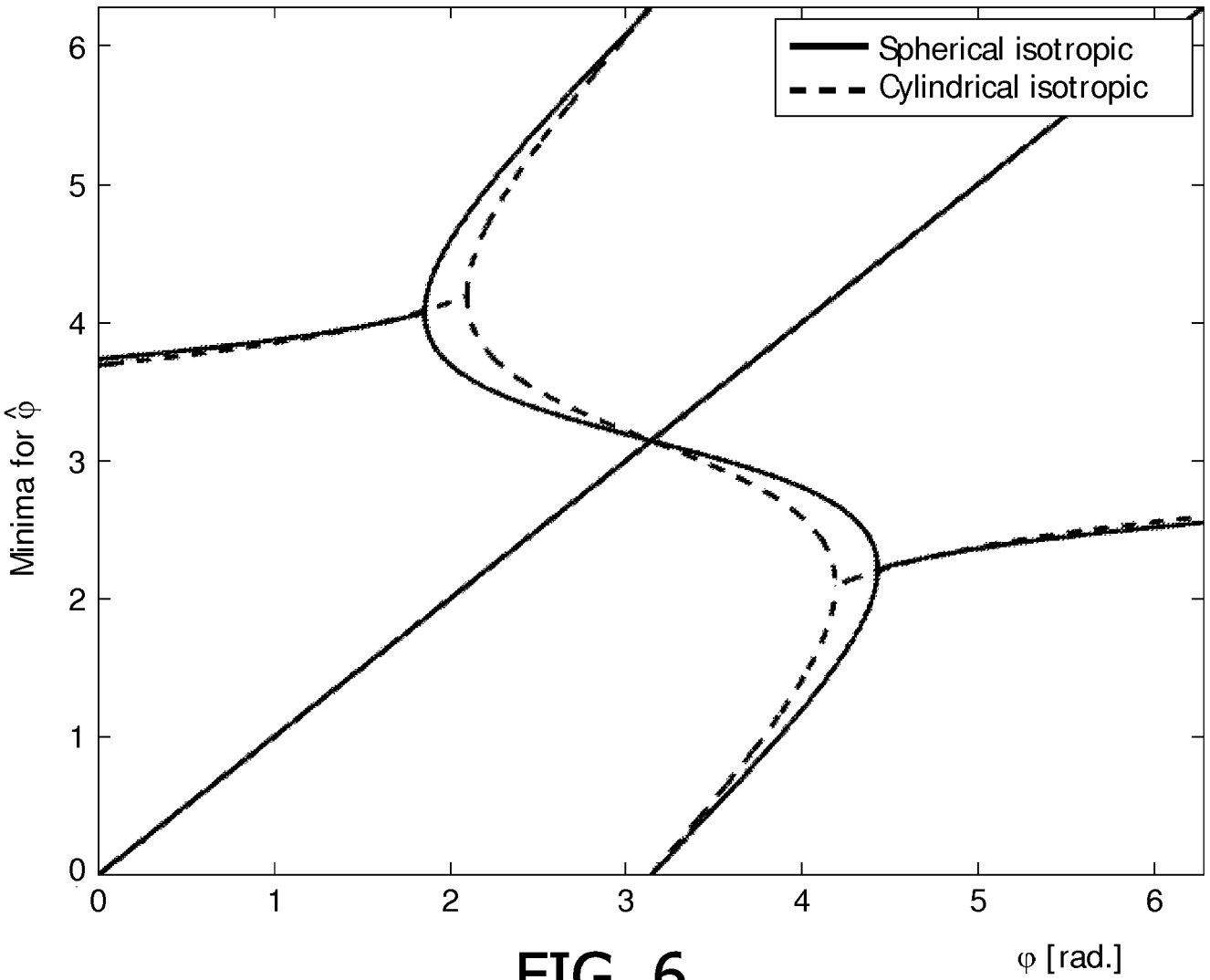
FIG. 6 illustrates an example of local minima for the cost function of FIG. 5.

FIG. 5 illustrates some examples of this cost function for a scenario wherein there is a single point interferer at the direction of $\phi$ equal to 1, 2 and 3 radians respectively (i.e. the angle difference $\phi$ between the desired direction and the direction between an actual interferer is 1, 2 and 3 radians respectively). The cost function is shown as a function of the estimated direction, i.e. as a function of the steering of the null performed by the weights of the reference signals. FIG. 6 illustrate the cost function in the presence of noise which either may be spherical (coming from all directions) or cylindrical (coming from all directions in a two-dimensional plane). The situation for spherical noise is shown by a full line and the situation for cylindrical noise is shown by the dashed line.

Some observations can be made from FIG. 5. Firstly, it is clear that in all situations, a notch (and specifically a null) exists for the right estimate, i.e. when $\hat{\phi}=\phi$. However, it is clear that whereas this null is indeed a local minimum for the cost function, it is not the only local minimum. In particular, in some cases local minima are found which do not correspond to a null and in some cases other nulls exist. Thus, it can be seen that merely determining the angle estimate by finding local minima is not a sufficient approach.

This can further be seen in FIG. 6 which illustrates the local minima of the cost function for different directions $\phi$ of an actual point source interferer. Again, it can be seen that there is a local minimum for the correct value (i.e. a minimum exists $\hat{\phi}=\phi$ for as indicated by the diagonal line). However, in addition it can be seen that at least one and possibly two other local minima exist. For example, for an interferer at an angle of 1 radian, a cost function minimum exists at the right value of 1 radian but also at the wrong value of around 3.8 radians. Furthermore, for an interferer angle between around 2 radians to 4.3 radians, two wrong local minima exist.

However, a further observation is that the correct minimum is always the only local minimum in the phase interval from either 0 to $\pi$ or from $\pi$ to $2\pi$. Thus, for an interferer angle within the interval of $[0;\pi]$, the only local minimum in the interval of $[0;\pi]$ is the correct value. Similarly, for an interferer angle within the interval of [π;2π], the only local minimum in the interval of [π;2π] is the correct value.

This realization is exploited in the system of FIG. 1. Specifically, the estimation circuit 109 is arranged to determine a local minimum in the angle interval of [0;π] and a local minimum in the angle interval of [π;2π]. Thus, the estimation circuit 109 determines two angles for which the cost function corresponding to the power of the output signal is minimized. This approach ensures that one of the determined local minima will correspond to the correct estimated angle.

The estimation circuit 109 then proceeds to select one of the two estimated values as the estimated angle that is used to control the beamforming by the beamform circuit 107. Thus, one of the local minima is selected and used to calculate the weights for the noise reference signals using the equations that also optimize diffuse noise performance.

It will be appreciated that different criteria for selecting between the determined local minima may be used. For example, in some embodiments, a simple beamforming may be applied to the microphone signals such that a beam is formed in each of the two directions in order to measure the interference level in those directions. The direction having the highest level is then selected as it corresponds to the most dominant interference.

However, in the specific example, the selection of the correct local minima is based on the gradient of the cost function at a specific angle which separates the two angle intervals (i.e., it is inbetween the two angle intervals and may specifically be an endpoint of one or both of the intervals). In the specific example, the gradient at π is determined and is used to select the appropriate local minimum. Specifically, if the cost function has a negative gradient for then the local minimum in the interval of [0;π] is selected and otherwise the local minimum in the interval of [π;2π] is selected. Indeed, it has been found that such a selection provides a very reliable indication of the correct local minima and thus provides a low complexity but efficient selection approach.

Intuitively, it can be understood as follows. The directional beam pattern for yields a cardioid response with only a single null. The gradient of the cost function for therefore yields the direction toward the true value of ϕ. If the gradient is positive the true value of ϕ lies in the interval [π;2π]. If the gradient is positive, the true value of ϕ lies in the interval [0;π].

It should also be noted that in some embodiments, all the local minima of the function may be determined and separated into the two angle intervals. Indeed, in such an embodiment, the detection of two local minima in one interval may automatically lead to the selection of the other minimum (i.e. the one in the other angle interval). This approach is based on the realization that (as illustrated in FIG. 6), the correct local minimum will be the only local minimum in the angle interval. It will also be appreciated that this leads to the conclusion that it is not necessary to identify more than one minimum in each angle interval as any non-identified local minima will inherently not be the correct minimum as it is in an angle interval with more than one minimum.

In the system of FIG. 1, the determination of the local minima is performed by performing a gradient search in each angle interval.

Thus, the estimation circuit 109 performs a sidelobe cancelling operation corresponding to that of the beamform circuit 107 while using an input angle value that is constantly updated and biased in the direction that will reduce the cost function. This approach will result in the angle variable ending in a local minimum.

Specifically, a steepest descent update equation for $\hat{\phi}$ can be derived by stepping in the direction opposite to the surface of the cost function with respect to $\hat{\phi}$:

$$\hat{\phi}[k+1]=\hat{\phi}[k]-\mu\nabla J(\hat{\phi}),$$

with a gradient given by:

$$\nabla J(\hat{\varphi}) = \frac{\partial \varepsilon\{y^2[k]\}}{\partial \hat{\varphi}},$$

and where μ is the update step-size with 0<μ<1.

In practice, the mean value is not available and therefore an instantaneous estimate of the gradient is used:

$$\hat{\nabla} J(\hat{\varphi}) = \frac{\partial y^2[k]}{\partial \hat{\varphi}}$$

by inserting the previously derived formulas for y[k] and performing the derivation, this can be shown to lead to:

$$\begin{aligned}\hat{\nabla} J(\hat{\varphi}) &= \frac{\partial y^2[k]}{\partial \hat{\varphi}} \\ &= 2y[k](X_1 r_1[k] + X_2 r_2[k]),\end{aligned}$$

where $$X_1 = \frac{6\sin\hat{\varphi}(\cos\hat{\varphi} - 1)}{N},$$

$$X_2 = \frac{3\cos^2\hat{\varphi} - 18\cos\hat{\varphi} - 17}{N},$$

$$N = 9\cos^3\hat{\varphi} + 21\cos^2\hat{\varphi} - 5\cos\hat{\varphi} - 25.$$

Thus, the update value for the angle input variable of the gradient search is a function of an output signal of the sidelobe canceller and of the first and second noise reference signals.

In the above example, the update value is dependent on the power of the noise references. In order to compensate for this, the estimation circuit 109 may determine a power estimate for one or both of the noise reference signals and normalize the update value accordingly.

Accordingly, the following update equation for the gradient search may be used:

$$\hat{\varphi}[k+1] = \hat{\varphi}[k] + 2\mu\frac{y[k](X_1 r_1[k] + X_2 r_2[k])}{\hat{P}_{r_1}[k] + \hat{P}_{r_2}[k] + \epsilon}.$$

where ϵ is a small value to prevent zero division and is the power estimate of the i'th noise reference signal. This can specifically be calculated by a recursive averaging:

$$\hat{P}_{r_i}[k+1]=\beta\hat{P}_{r_i}[k]+(1-\beta)r_i^2[k],$$

where β is a suitable design parameter.

Thus, for each angle interval, the estimation circuit 109 operates a sidelobe canceller applied to the same signals as the sidelobe canceller of the beamform circuit 107. However, the sidelobe cancellers are operated based on an input angle variable which corresponds to a current estimate of the angle to the assumed point source interferer. The input angle variable is continuously updated using the gradient search approach such that it will converge on the local minimum in the angle interval.

The estimation circuit 109 then selects between the current values of the input angle variables and uses this result as the estimated angle for the assumed point source interferer. The selection is based on the gradient of the cost function for an input variable of $\pi$. The estimation circuit 109 may specifically determine this by operating a further sidelobe canceller process on the input signals but with a fixed angle value of $\pi$. Specifically, the estimation circuit 109 may continuously evaluate the update value:

$$\hat{\nabla} J(\hat{\phi}) = \frac{\partial y^2[k]}{\partial \hat{\phi}} = 2y[k](X_1 r_1[k] + X_2 r_2[k]),$$

for $\hat{\phi}=\pi$. The derived values may be averaged over time and the sign of the averaged value (i.e. the gradient of the cost function at $\pi$) is then used to select which of the angles determined by the gradient searches is used.

It will be appreciated that whereas the previous discussion illustrated the principle by referring to the use of four sidelobe cancellers (one for the beamform circuit 107, one for each gradient search, and one for determining the gradient at $\pi$), this is merely used to illustrate the principle. Indeed, in many embodiments, the same sidelobe canceller may be implemented, e.g. as a subroutine, and used for the different purposes and with different input angles.

It will also be appreciated that typically, the beamform circuit 107 will not repeat a sidelobe canceller operation for the estimated angle but will directly use the output signal calculated for the selected angle when performing the estimation.

In the example, the gradient search is arranged to re-initialize the gradient search if the value of the angle input variable moves out of the corresponding angle interval. Specifically, a re-initialization of the gradient search may be performed if the two gradient searches reach a scenario wherein the both have angle values in the same angle interval. For example, if during the gradient search in the $[0;\pi]$ interval, the updated angle value moves into the $[\pi;2\pi]$ interval such that both gradient searches have current values within this interval, the gradient search is re-initialized. The re-initialization is specifically performed by resetting the value of the input angle variable of one of the two gradient searches to an initial value. The initial value may for example be a fixed value such as the midpoint in the interval (i.e. $\pi/2$ and $3\pi/2$).

From FIG. 6, we can see that the relevant quadrant for the gradient search in the interval $[0;\pi]$ is the lower-left quadrant. For the gradient search in the interval $[\pi;2\pi]$, the upper-right quadrant is relevant.

Figure 7:
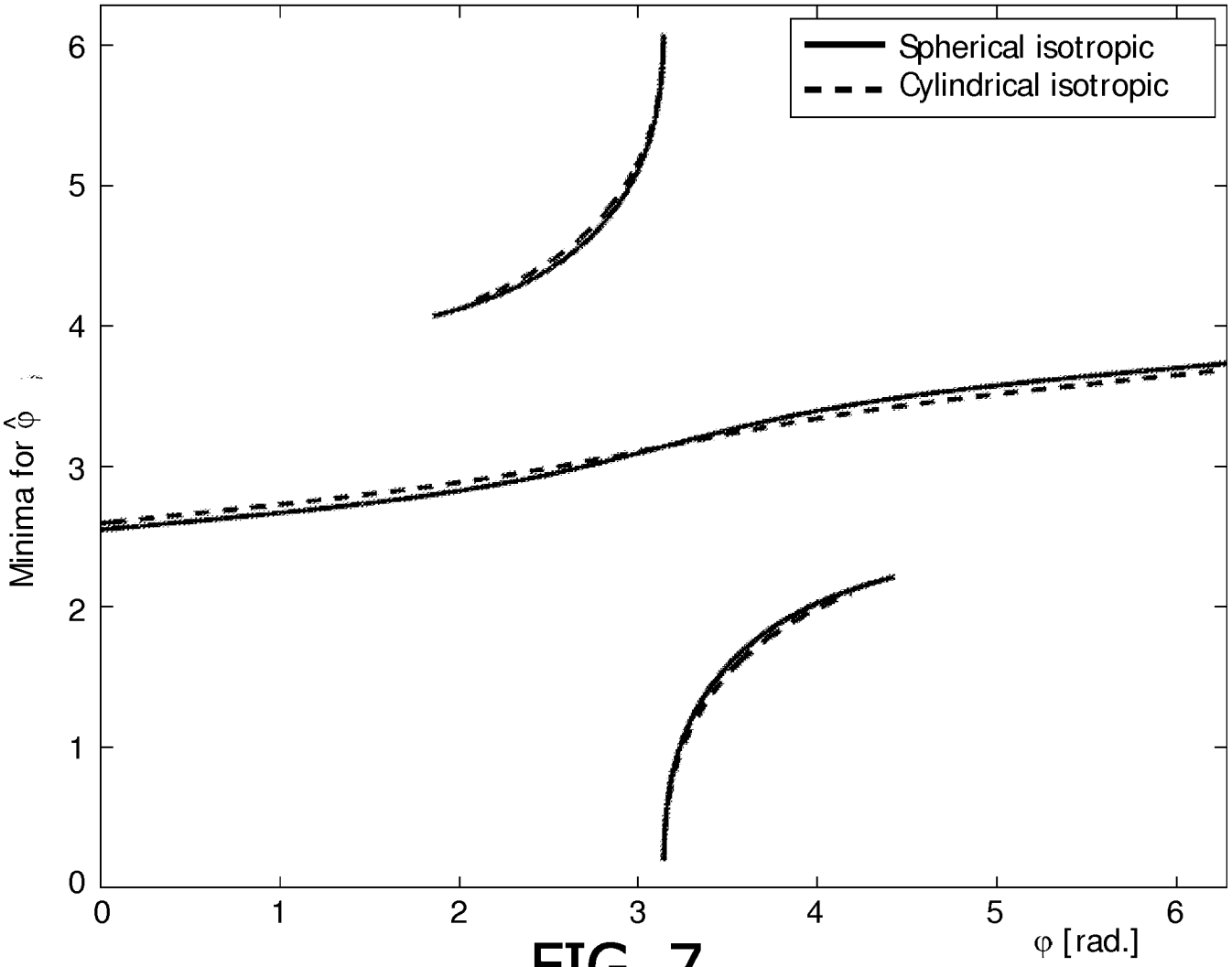
FIG. 7 illustrates an example of local maxima for the cost function of FIG. 5

Next looking at the lower-left quadrant for the gradient search in the interval $[0;\pi]$, we can see from FIG. 6 and FIG. 7 (showing respectively the minima and maxima of the cost function) that a re-initialization within this interval would only lead to a correct convergence $\hat{\phi}=\phi$ in case the re-initialization would be done in the range $[0;\eta]$, where $\eta\approx 2.55$.

When the re-initialization would be larger than $\eta$, there is a risk that the gradient search again ends up in the wrong quadrant, i.e. the upper-left quadrant. Especially when $\phi$ is equal or close to zero, it is mandatory that re-initialization is done in the range $[0;\eta]$, where $\eta\approx 2.55$.

Hence, for the re-initialization, it is safe to choose a midpoint in the interval $[0;\eta]$, (i.e. $\eta/2$), where $\eta\approx 2.55$.

Figure 8:
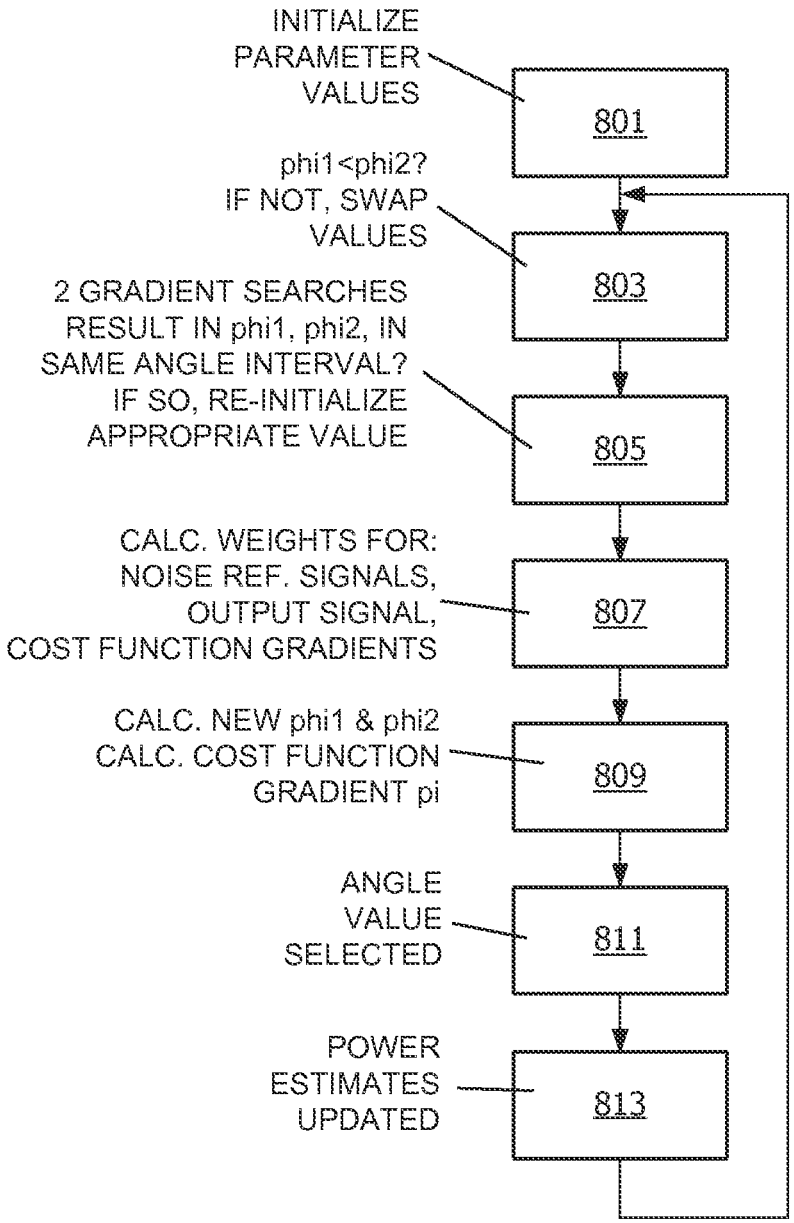
FIG. 8 illustrates an example of a method for capturing audio with an adaptable directional characteristic in accordance with some embodiments of the invention.

A specific example of the approach that may be used is illustrated in FIG. 8. In step 801, the parameter values are initialized.

Step 801 is followed by step 803 wherein it is ensured that $\hat{\phi}_1[k]$ is smaller than $\hat{\phi}_2[k]$ (if not the two variable values are simply swapped).

Step 803 is followed by step 805 wherein it is determined if the two gradient searches have resulted in angle values, $\hat{\phi}_1[k]$, $\hat{\phi}_2[k]$, in the same angle interval. If so, the appropriate value is re-initialized to ensure there is one angle in each angle interval.

Step 805 is followed by step 807 wherein the weights for the noise reference signals, the resulting output signal and the cost function gradients are calculated.

Step 807 is followed by step 809 wherein the new values for the angle input variables, $\hat{\phi}_1[k]$, $\hat{\phi}_2[k]$, of the gradient searches are calculated. Furthermore, the filtered cost function gradient at it is calculated.

Step 809 is followed by step 811 wherein the appropriate angle value is selected based on the filtered cost function gradient at $\pi$.

Step 811 is followed by step 813 wherein the power estimates for the noise reference signals used in the update value determination are updated.

After step 813 the method returns to step 803 to process the next sample.

A pseudo-code of an algorithm corresponding to FIG. 1 may be represented as:

```
Initialize 0 < φ̂1[0] = η/2, π < φ̂2[0] < 2π − η/2
Initialize ∇̂3,sm[0] = π, P̂r1[0] = r1^2[0], P̂r2[0] = r2^2[0]
for k = 0, ∞: do
   if (φ̂1[k] > φ̂2[k]) then
      swap(φ̂1[k], φ̂2[k]).
   end if
   if (φ̂1[k] > π) & (φ̂2[k] > π) then
      φ̂1[k] = η/2.
   end if
   if (φ̂1[k] ≤ π) & (φ̂2[k] ≤ π) then
      φ̂2[k] = 2π − η/2.
   end if
   for i = 1, 3: do
      ŵ1 = f(cosφ̂i[k])
      ŵ2 = f(sinφ̂i[k], ŵ1)
      y[k] = p[k] − (ŵi + 2α)r1[k] − ŵ2r2[k]
      N = 9 cos^3φ̂i[k] + 21 cos^2φ̂i[k] − 5 cosφ̂i[k] − 25
      X1 = [6 sinφ̂i[k](cosφ̂i[k] − 1)]/N
      X2 = [3 cos^2φ̂i[k] − 18 cosφ̂i[k] − 17]/N

      ∇̂J(φ̂i) = 2y[k](X1r1[k] + X2r2[k]) / (Pr1[k] + Pr2[k] + ε)

   end for
   φ̂1[k + 1] = mod(trunc(φ̂1[k], 1) + μ∇̂J(φ̂1), 2π)
   φ̂2[k + 1] = mod(trunc(φ̂2[k], 1) + μ∇̂J(φ̂2), 2π)
   ∇̂3,sm[k + 1] = βgrad∇̂3,sm[k] + (1 − βgrad)∇̂J(φ̂3)
   if (∇̂3,sm[k + 1]) > 0) then
      φ̂n[k] = φ̂1[k] + φ̂3.
   else
      φ̂n[k] = φ̂2[k] + φ̂3.
   end if
   Pr1[k + 1] = βPr1[k] + (1 − β)r1^2[k]
   Pr2[k + 1] = βPr2[k] + (1 − β)r2^2[k]
end for
```

In the specific example, the number of microphones in the microphone array 101 corresponded to the number of reference beams (i.e. three). However, in some embodiments, the microphone array may comprise more microphones than reference beams.

Specifically the microphone array 101 may comprise at least four microphones. The system may still only generate three reference beams and may specifically be arranged to combine signals from at least two microphones prior to generating the reference beams. Thus, the reference processor 105 may still only receive three input signals and generate three reference beams from these. However, at least one of these input signals may be generated by combining (and specifically averaging or adding (e.g. by a weighted summation)) the signals from at least two microphones. Such an approach may provide improved noise performance in many scenarios as the level of uncorrelated noise may be averaged. Furthermore, using more microphones on a particular area, has the advantage that spatial aliasing will occur at a higher frequency.

It will be appreciated that the above description for clarity has described embodiments of the invention with reference to different functional circuits, units and processors. However, it will be apparent that any suitable distribution of functionality between different functional circuits, units or processors may be used without detracting from the invention. For example, functionality illustrated to be performed by separate processors or controllers may be performed by the same processor or controllers. Hence, references to specific functional units or circuits are only to be seen as references to suitable means for providing the described functionality rather than indicative of a strict logical or physical structure or organization.

The invention can be implemented in any suitable form including hardware, software, firmware or any combination of these. The invention may optionally be implemented at least partly as computer software running on one or more data processors and/or digital signal processors. The elements and components of an embodiment of the invention may be physically, functionally and logically implemented in any suitable way. Indeed the functionality may be implemented in a single unit, in a plurality of units or as part of other functional units. As such, the invention may be implemented in a single unit or may be physically and functionally distributed between different units, circuits and processors.

Although the present invention has been described in connection with some embodiments, it is not intended to be limited to the specific form set forth herein. Rather, the scope of the present invention is limited only by the accompanying claims. Additionally, although a feature may appear to be described in connection with particular embodiments, one skilled in the art would recognize that various features of the described embodiments may be combined in accordance with the invention. In the claims, the term comprising does not exclude the presence of other elements or steps.

Furthermore, although individually listed, a plurality of means, elements, circuits or method steps may be implemented by e.g. a single circuit, unit or processor. Additionally, although individual features may be included in different claims, these may possibly be advantageously combined, and the inclusion in different claims does not imply that a combination of features is not feasible and/or advantageous. Also the inclusion of a feature in one category of claims does not imply a limitation to this category but rather indicates that the feature is equally applicable to other claim categories as appropriate. Furthermore, the order of features in the claims do not imply any specific order in which the features must be worked and in particular the order of individual steps in a method claim does not imply that the steps must be performed in this order. Rather, the steps may be performed in any suitable order. In addition, singular references do not exclude a plurality. Thus references to "a", "an", "first", "second" etc do not preclude a plurality. Reference signs in the claims are provided merely as a clarifying example shall not be construed as limiting the scope of the claims in any way.

The invention claimed is:

1. An audio beamforming apparatus comprising:

a receiving circuit for receiving signals from an at least two-dimensional microphone array comprising at least three microphones;

a reference circuit for generating at least three reference beams from the microphone signals;

combining circuit for generating an output signal corresponding to a desired beam pattern by combining the reference beams in response to a first direction of a desired sound source and a direction estimate for an interfering sound source;

an estimation circuit for generating the direction estimate by:

determining a first angle corresponding to a local minimum for a power measure of the output signal in a first angle interval, determining a second angle corresponding to a local minimum for a power measure of the output signal in a second angle interval, and determining the direction estimate as an angle selected from a set of angles corresponding to local minima for a power measure of the output signal, the set of angles comprising at least the first angle and the second angle; and wherein the combining circuit is arranged to determine combination parameters for the combining of the reference beams to provide a notch in an angle corresponding to the direction estimate of an interfering point source and a maximization of a directivity cost measure of the interfering point source, the directivity cost measure being indicative of a ratio between a gain in the first direction and an average gain.

2. The apparatus as claimed in claim 1, wherein the estimation circuit is arranged to select the direction estimate as one of the first angle and the second angle in response to a gradient of a power measure of the output signal as a function of the direction estimate for an angle separating the first angle interval and the second angle interval.

3. The apparatus as claimed in claim 1, wherein the first angle interval comprises angles from 0 to w and the second angle interval comprises angles from $\pi$ to $2\pi$.

4. The apparatus as claimed in claim 3, wherein the estimation circuit is arranged to select the direction estimate as one of the first angle and the second angle in response to a gradient of a power measure of the output signal as a function of the direction estimate for an angle of $\pi$.

5. The apparatus as claimed in claim 1, wherein the combining circuit comprises a sidelobe canceller.

6. The apparatus as claimed in claim 5, wherein the sidelobe canceller is arranged to generate the output signal as a weighted combination of at least a primary signal, a first noise reference signal and a second noise reference signal.

7. The apparatus as claimed in claim 6, wherein the combining circuit is arranged to calculate weights for the first and second noise reference signals in response to the direction estimate and a maximization of the directivity cost measure.

8. The apparatus as claimed in claim 5, wherein the estimation circuit is arranged to determine at least one of the first and second angles by a gradient search applied to a sidelobe canceller corresponding to the sidelobe canceller of the combining circuit and having an angle input variable.

9. The apparatus as claimed in claim 8, wherein an update value for the angle input variable is determined as a function of an output signal of the sidelobe canceller for a current phase value of the angle input variable, and a first and second noise reference signal of the sidelobe canceller for the current phase value.

10. The apparatus as claimed in claim 9, wherein the first and second noise reference signals are weighted as a function of the current phase value.

11. The apparatus as claimed in claim 9, wherein the estimation circuit is arranged to determine a power estimate for at least one of the first and second noise reference signals and to perform a normalization of the update value as a function of the power estimate.

12. The apparatus as claimed in claim 1, wherein the at least two-dimensional microphone array comprises at least four microphones, and the apparatus comprises a circuit for combining signals from at least two of the at least four microphones prior to generating the reference beams.

13. The apparatus as claimed in claim 1, wherein said apparatus further comprises the at least two-dimensional microphone array, the at least two-dimensional microphone array comprising directional microphones having a maximum response in a direction outwardly of a perimeter of the at least two-dimensional microphone array.

14. A method of audio beamforming comprising:

receiving signals from an at least two-dimensional microphone array comprising at least three microphones;

generating at least three reference beams from the microphone signals;

generating an output signal corresponding to a desired beam pattern by combining the reference beams in response to a first direction of a desired sound source and a direction estimate for an interfering sound source;

generating the direction estimate by:

determining a first angle corresponding to a local minimum for a power measure of the output signal in a first angle interval, determining a second angle corresponding to a local minimum for a power measure of the output signal in a second angle interval, and determining the direction estimate as an angle selected from a set of angles corresponding to local minima for a power measure of the output signal, the set of angles comprising at least the first angle and the second angle; and wherein the combining of the reference beams comprises determining combination parameters for the combining of the reference beams to provide a notch in an angle corresponding to the direction estimate and a maximization of a directivity cost measure, the directivity cost measure being indicative of a ratio between a gain in the first direction and an energy averaged gain.

15. A non-transitory computer readable storage medium encoded with a computer program having steps for causing a processor to carry out the method of claim 14.

* * * * *